US007108534B2

(12) United States Patent
Fabian

(10) Patent No.: US 7,108,534 B2
(45) Date of Patent: Sep. 19, 2006

(54) ELECTRICAL CONNECTOR ASSEMBLY HAVING AT LEAST TWO KEYING ARRANGEMENTS

(75) Inventor: David James Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/051,077

(22) Filed: Feb. 4, 2005

(65) Prior Publication Data

US 2006/0178029 A1 Aug. 10, 2006

(51) Int. Cl.
*H01R 13/28* (2006.01)

(52) U.S. Cl. ..... 439/284; 439/295

(58) Field of Classification Search ..... 439/284, 439/287, 290–293, 295, 680, 701
See application file for complete search history.

(56) References Cited

U.S. PATENT DOCUMENTS

| | | | | | |
|---|---|---|---|---|---|
| 3,129,993 | A | | 4/1964 | Ross | 339/49 |
| 3,654,586 | A | * | 4/1972 | Winkler | 439/295 |
| 3,794,957 | A | * | 2/1974 | Winkler | 439/295 |
| 3,840,839 | A | | 10/1974 | Smaczny et al. | 339/49 R |
| 3,909,099 | A | * | 9/1975 | Winkler | 439/295 |
| 4,227,762 | A | | 10/1980 | Scheiner et al. | |
| 4,596,436 | A | * | 6/1986 | Kraemer et al. | 439/701 |
| 4,734,052 | A | * | 3/1988 | Vandame | 439/293 |
| 4,778,411 | A | | 10/1988 | Rudy, Jr. et al. | |
| 4,781,626 | A | | 11/1988 | Lazarchik | |
| 4,990,099 | A | * | 2/1991 | Marin et al. | 439/284 |
| 4,997,386 | A | * | 3/1991 | Kawachi et al. | 439/352 |
| 5,106,320 | A | * | 4/1992 | Kinnear | 439/295 |
| 5,236,375 | A | * | 8/1993 | Kachlic | 439/607 |
| 5,370,556 | A | | 12/1994 | Olsson | |
| 5,370,557 | A | | 12/1994 | Olsson | |
| 5,427,549 | A | * | 6/1995 | Smith et al. | 439/701 |
| 5,567,182 | A | * | 10/1996 | Ishii et al. | 439/701 |
| 5,660,567 | A | | 8/1997 | Nierlich et al. | |
| 6,089,898 | A | | 7/2000 | Lincoln, III et al. | 439/357 |

FOREIGN PATENT DOCUMENTS

| | | |
|---|---|---|
| DE | 296 18 214 U1 | 1/1997 |
| DE | 197 09 694 A1 | 10/1998 |
| DE | 102 43 313 A1 | 4/2004 |
| EP | 0 336 695 A2 | 10/1989 |
| EP | 0 418 782 A2 | 3/1991 |

* cited by examiner

*Primary Examiner*—Gary F. Paumen

(57) ABSTRACT

An electrical connector assembly is disclosed having a first and a second electrical connector. Each electrical connector includes a housing having electrical contacts therein wherein each contact of the first electrical connector mates or connects with a corresponding contact of the second electrical connector. A keying arrangement is provided having keying walls for inhibiting the mating except for mating a first electrical connector to a designated second electrical connector. Another keying arrangement is provided by two pairs of electrical contact housings fitted within interior cavities of the first and second electrical connectors. Each electrical contact housing includes a key sized to slip fit into an opposing opening of an electrical contact housing fitted within an interior cavity of either the first or second electrical connector. Each key is arranged so that the first and second electrical connector housings will mate only when the four keys are in mating alignment with their respective opening.

25 Claims, 9 Drawing Sheets

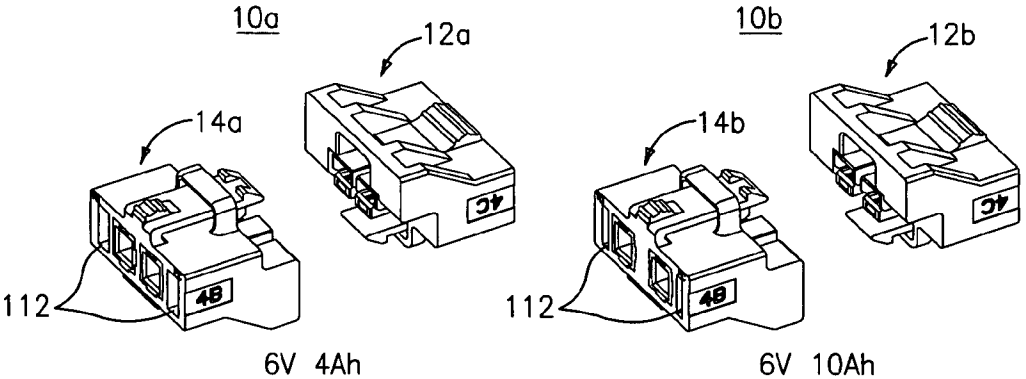
FIG. 9a
FIG. 9b
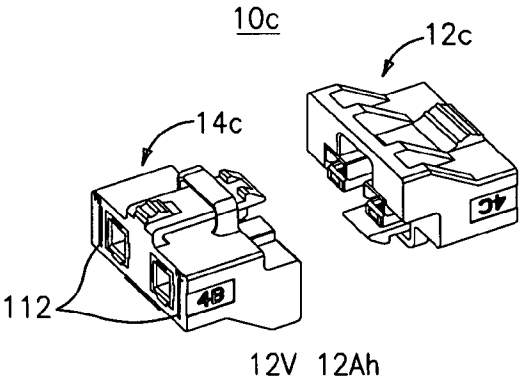
FIG. 9c
FIG. 9d
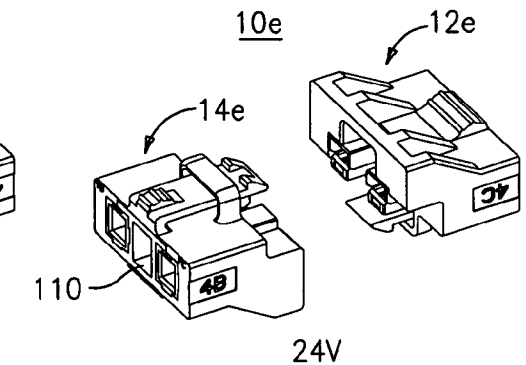
FIG. 9e
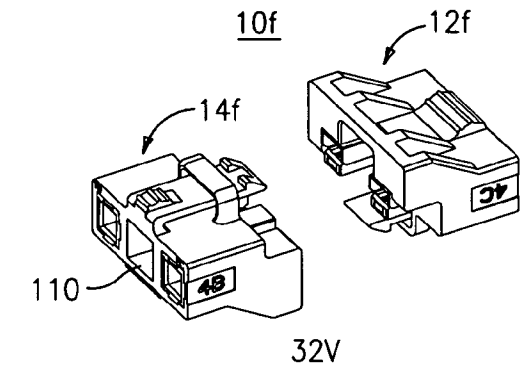
FIG. 9f

ELECTRICAL CONNECTOR ASSEMBLY HAVING AT LEAST TWO KEYING ARRANGEMENTS

FIELD OF THE INVENTION

The present disclosure is directed to a keying arrangement for electrical connector assemblies that prevent inadvertent mating of connector halves that are not intended to be mated.

BACKGROUND OF THE INVENTION

In electrical equipment having multiple modules or units that are interconnected, it is desirable to provide a keying system that uniquely defines plug and receptacle pairs that are to be mated. There are many such systems in use in the industry. For example, U.S. Pat. No. 4,778,411 discloses mating electrical connector housings having hexagonal nests formed therein containing hexagonal shaped keys that are positionable in any of six unique angular positions. Each housing has a key that is in axial alignment with a corresponding key in the other housing. Mating of the two housings is prevented unless the two keys are in mutually complimentary angular positions. The shanks of the keys include an undercut that mates with an inwardly facing bead on the interior of the nest and a split end to provide a snap action when the keys are pressed into their seats.

U.S. Pat. No. 5,370,557 discloses a keying arrangement for low profile electrical connectors. The opposing ends of a mating plug and receptacle have polygonal openings formed completely through their housings that contain opposing polygonal-shaped keys that are axially aligned. Each of the keys is retained in its respective polygonal opening by a pair of wing-like flanges extending from the key that overlies a first surface formed in the housing adjacent the polygonal opening and a locking tab projecting from the key that underlies another surface spaced from the first surface.

Additional keying arrangements are needed which are novel in design and structure than prior art keying arrangements. In particular, what is needed is a connector keying arrangement having a novel design and structure that effectively prevents inadvertent mating of the contacts of a first connector with the contacts of a second connector in an electrical connector assembly when the electrical ratings of the first and second connectors are different. What is also needed is a connector locking arrangement having a novel design and structure that effectively connects and interlocks the two connectors of the electrical connector assembly.

SUMMARY OF THE INVENTION

It is an aspect of the present disclosure to provide keying arrangements for an electrical connector assembly having two connector housings, i.e., a first and a second connector, which are hermaphroditic or genderless.

It is also an aspect for the keying arrangements to work effectively for preventing inadvertent mating or connecting of the electrical contacts of a first connector having a particular electrical rating with the electrical contacts of a second connector having a different electrical rating.

In the present disclosure, an electrical connector assembly is disclosed having first and second electrical connectors which are hermaphroditic or genderless, i.e., the two electrical connectors are substantially identical. One difference is the corresponding keying wall for each electrical connector is laterally reversed with respect to the other electrical connector. For ease of describing herein the connection of the two electrical connectors of the electrical connector assembly, the first electrical connector is referred to as a plug and the second electrical connector as a receptacle for illustration purposes, even though either electrical connector can be referred to as the plug and receptacle since the electrical connectors are hermaphroditic as stated above.

Each plug and receptacle includes a housing having electrical contacts therein wherein each contact of the plug contacts a corresponding contact of the receptacle. A first keying arrangement is provided for polarizing to assure proper orientation of the plug with the receptacle during connection thereof.

A second keying arrangement is provided by the electrical connector assembly for inhibiting or preventing the mating of two identical connector housings, e.g., a battery connector housing to another battery connector housing. The second keying arrangement includes a keying wall formed on a face of the plug and a corresponding keying wall formed on an opposing face of the receptacle so that when a plug and a receptacle are in axial alignment, the keying walls of the two connector housings interlock.

A third keying arrangement is provided to prevent inadvertent mating of the electrical contacts of the plug having a particular electrical rating with the electrical contacts of the receptacle having a different electrical rating. The third keying arrangement is provided in part by two pairs of electrical contact housings where each electrical contact housing is fitted within a respective interior cavity of one of the electrical connector housings. In particular, each electrical contact housing fitted within an interior cavity of the receptacle includes a key having a rectangular shaped outer surface that is sized to slip fit into a respective opposing rectangular shaped opening of a respective electrical contact housing fitted within an interior cavity of a plug having the same electrical rating as the receptacle.

Likewise, each electrical contact housing fitted within an interior cavity of the plug having the same electrical rating as the receptacle includes a respective key having a rectangular shaped outer surface that is sized to slip fit into an opposing rectangular shaped opening of a respective electrical contact housing fitted within the interior cavity of the receptacle having the same electrical rating as the plug. Each key is arranged so that the plug and receptacle housings will mate only when the four keys are in mating alignment with their respective opening and the two connector housings are in axial alignment.

To prevent inadvertent mating of the electrical contacts of a plug having a particular electrical rating with the electrical contacts of a receptacle having a different electrical rating, the spacing between cavities of connector housings having different electrical ratings is different. This prevents axial alignment and hence mating of the keys of electrical contact housings fitted within a plug with the keys of electrical contact housings fitted within a receptacle where the receptacle has a different electrical rating than the plug. A locking arrangement is provided by the first keying arrangement for locking the receptacle and the plug and thereby locking each key within its respective opening when the receptacle and plug have the same electrical ratings.

DESCRIPTION OF THE FIGURES

FIGS. 9*a*–9*f* are perspective views of electrical connector assemblies in accordance with the present disclosure showing electrical contact housings having different spacing there between for plugs and receptacles having different electrical ratings.

DESCRIPTION OF THE PREFERRED EMBODIMENTS

Figure 1:
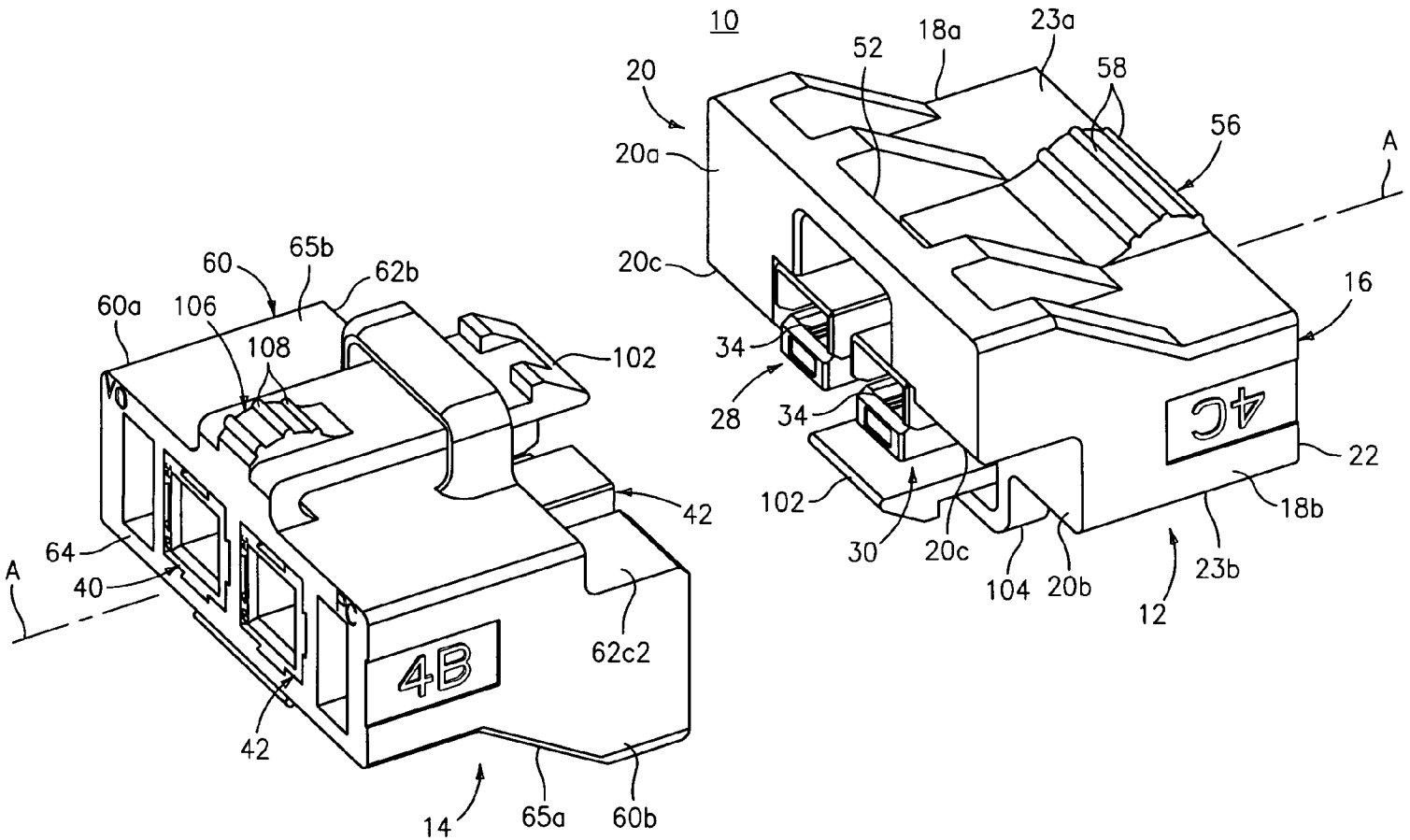
FIG. 1 is a perspective view of an electrical connector assembly incorporating the teachings of the present disclosure and showing the first and second connector housings, or the plug and the receptacle prior to mating.

Embodiments of the presently disclosed electrical connector assembly will now be described in detail with reference to the drawing figures wherein like reference numerals identify similar or identical elements. Terms such as "top", "bottom", "side", "end", etc. refer to the orientation of the figures or the direction of components and are simply used for convenience of description.

In the present disclosure, an electrical connector assembly is disclosed having first and second electrical connectors which are hermaphroditic or genderless, i.e., the two electrical connectors are substantially identical. One main difference is the corresponding keying wall for each connector is laterally reversed with respect to the other connector as will be described below. For ease of describing herein the connection of the two electrical connectors of the electrical connector assembly, the first electrical connector is referred to as a plug and the second electrical connector as a receptacle for illustration purposes, even though either electrical connector can be referred to as the plug and receptacle since the electrical connectors are hermaphroditic as stated above.

There is shown by FIGS. 1–8 an electrical connector assembly 10 having a first electrical connector or receptacle 12 and a second electrical connector or plug 14 in accordance with the present disclosure and connectable along a mating or connecting axis A. The receptacle 12 and plug 14 have insulated housings 16, 60 which are substantially identical in shape and design and include substantially complementary keying arrangements for polarizing to assure proper orientation of the receptacle 12 and plug 14 and for assuring a receptacle 12 having a particular electrical rating is mated or connected with a plug 14 having the same electrical rating.

A first keying arrangement of the electrical connector assembly 10 is provided for polarizing to assure proper orientation of receptacle 12 and plug 14. The first keying arrangement includes a retainer means having two locking tabs 100*a*, 100*b* each mounted at a respective mounting point to the insulated housings 16, 60. Each locking tab 100*a*, 100*b* is preferably integrally formed with the insulating housings 16, 60 and includes a distal end 102 configured and dimensioned for being received within respective openings 50, 66 defined by the insulating housings 16, 60, respectively. Each locking tab 100*a*, 100*b* is pivotable with respect to its mounting point, thereby causing it to pivot in a particular direction upon the distal end 102 contacting a portion of either housing 16 or 60.

Figure 7:
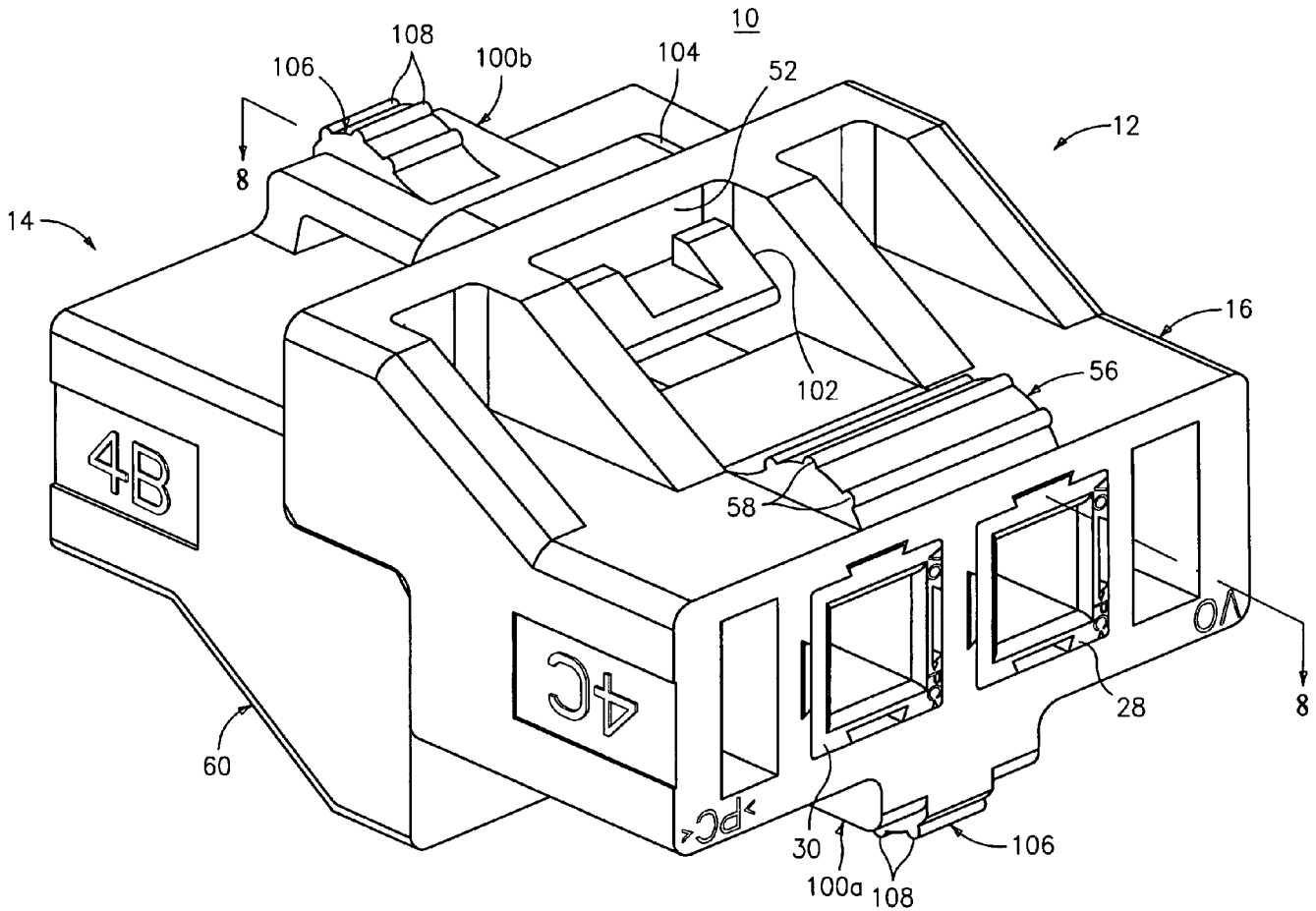
FIG. 7 is a perspective view of the plug and receptacle fully mated.
Figure 8:
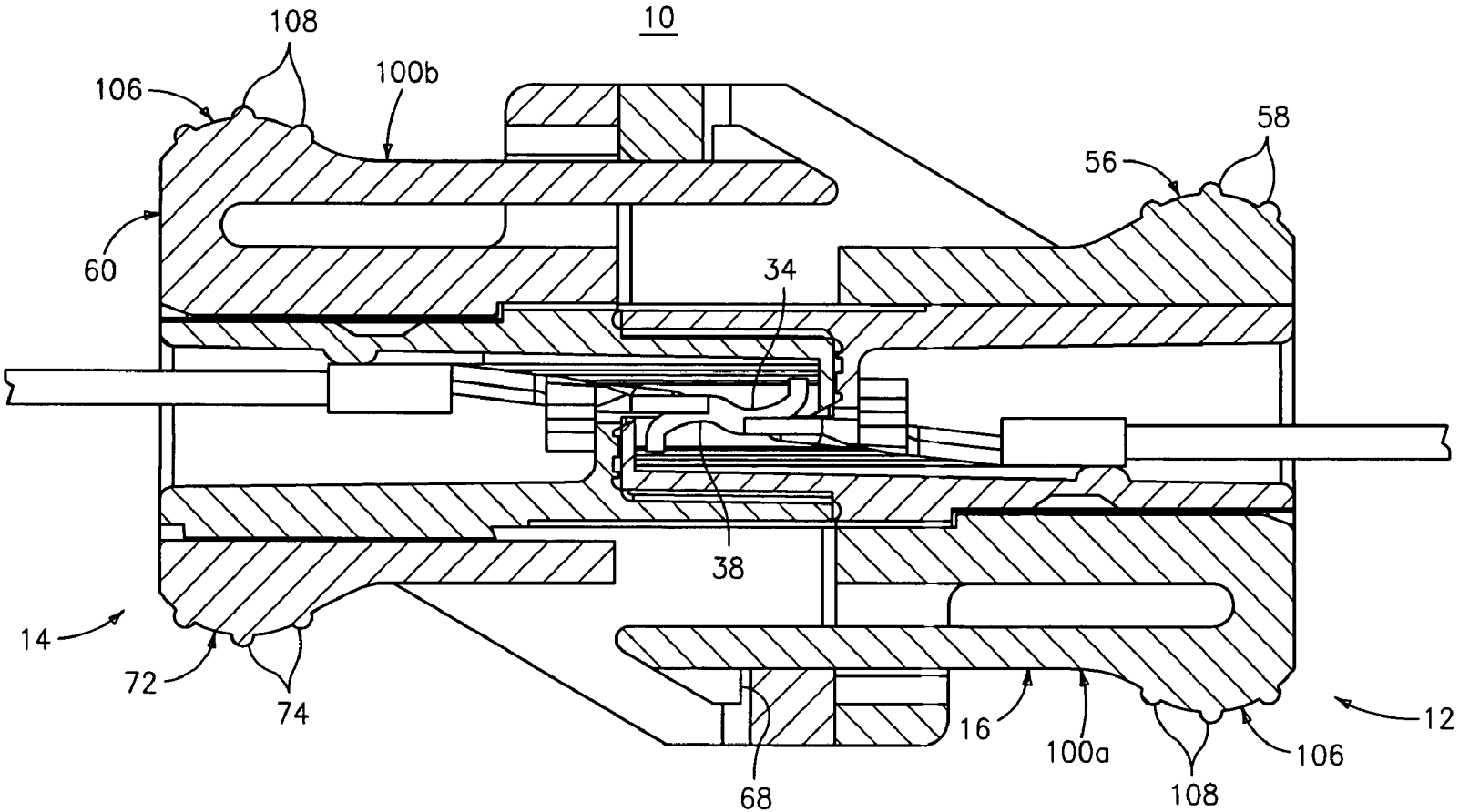
FIG. 8 is a cross-sectional view taken along line 8—8 in FIG. 7.

The distal end 102 of each locking tab is further configured and dimensioned for eventually pivoting opposite the particular direction for contacting in a locking configuration a surface of either housing 16 or 60 for mating the two housings 16, 60, as well as retaining the two housings 16, 60 in an interocked configuration as shown by FIGS. 7 and 8. If the two housings 16, 60 are not properly oriented with respect to each other or the mating axis, the two locking tabs 100*a*, 100*b* cannot be received within the respective openings 50, 66 for enabling the mating and retention of the two housings 16, 60.

Each housing 16, 60 includes an arced member 104 (FIGS. 3 and 5) surrounding each locking tab 100*a*, 100*b*. A proximal portion 106 of each locking tab 100*a*, 100*b* is raised in an arced configuration to facilitate and provide for the gripping of the insulating housings 16, 60 during connection thereof. To facilitate further gripping of the housings 16, 60, a portion of the raised proximal portion 106 of each locking tab 100*a*, 100*b* is also raised to form gripping members 108 thereon.

Figure 5:
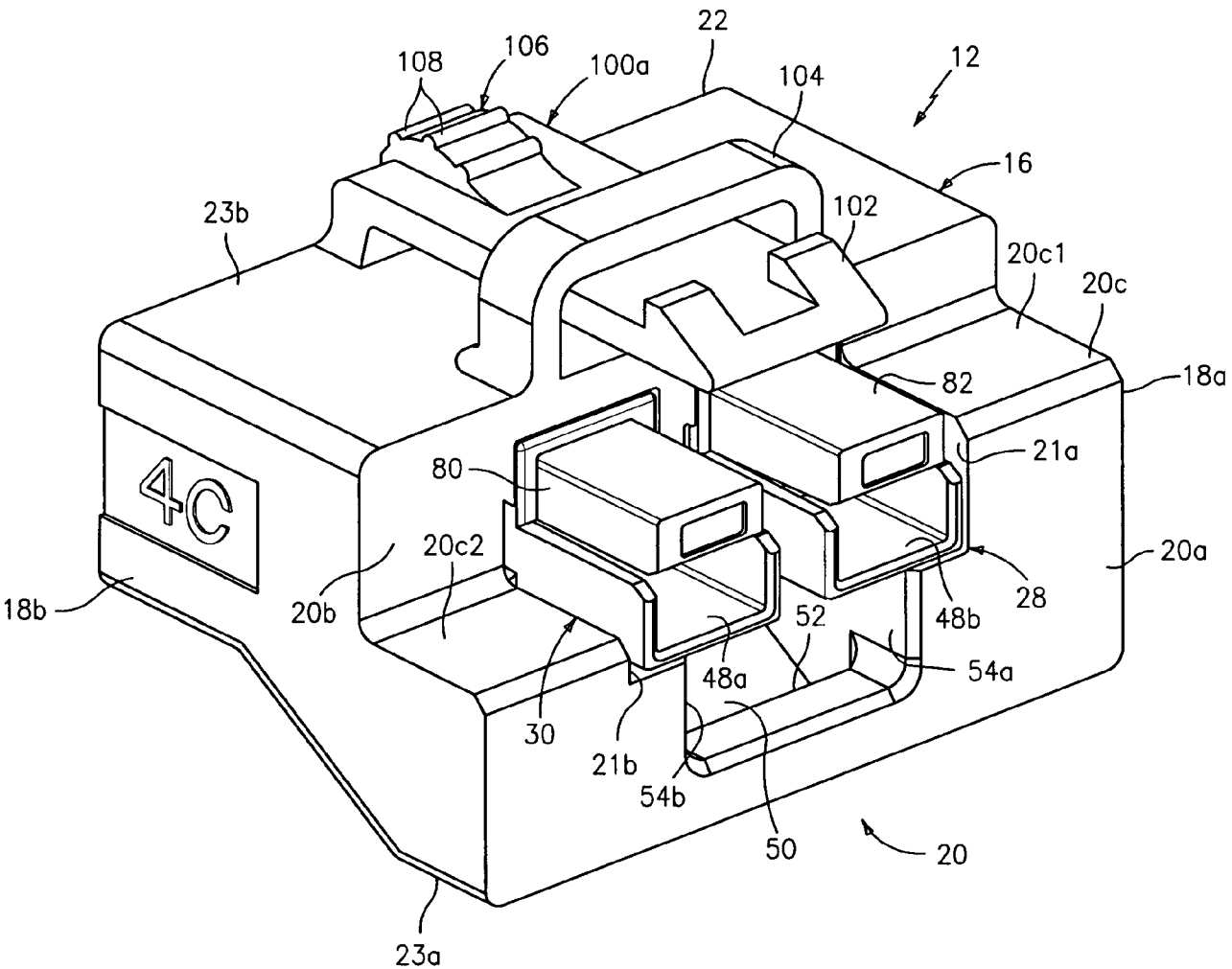
FIG. 5 is an enlarged perspective view of the receptacle shown in FIG. 1, showing the mating face thereof.
Figure 6:
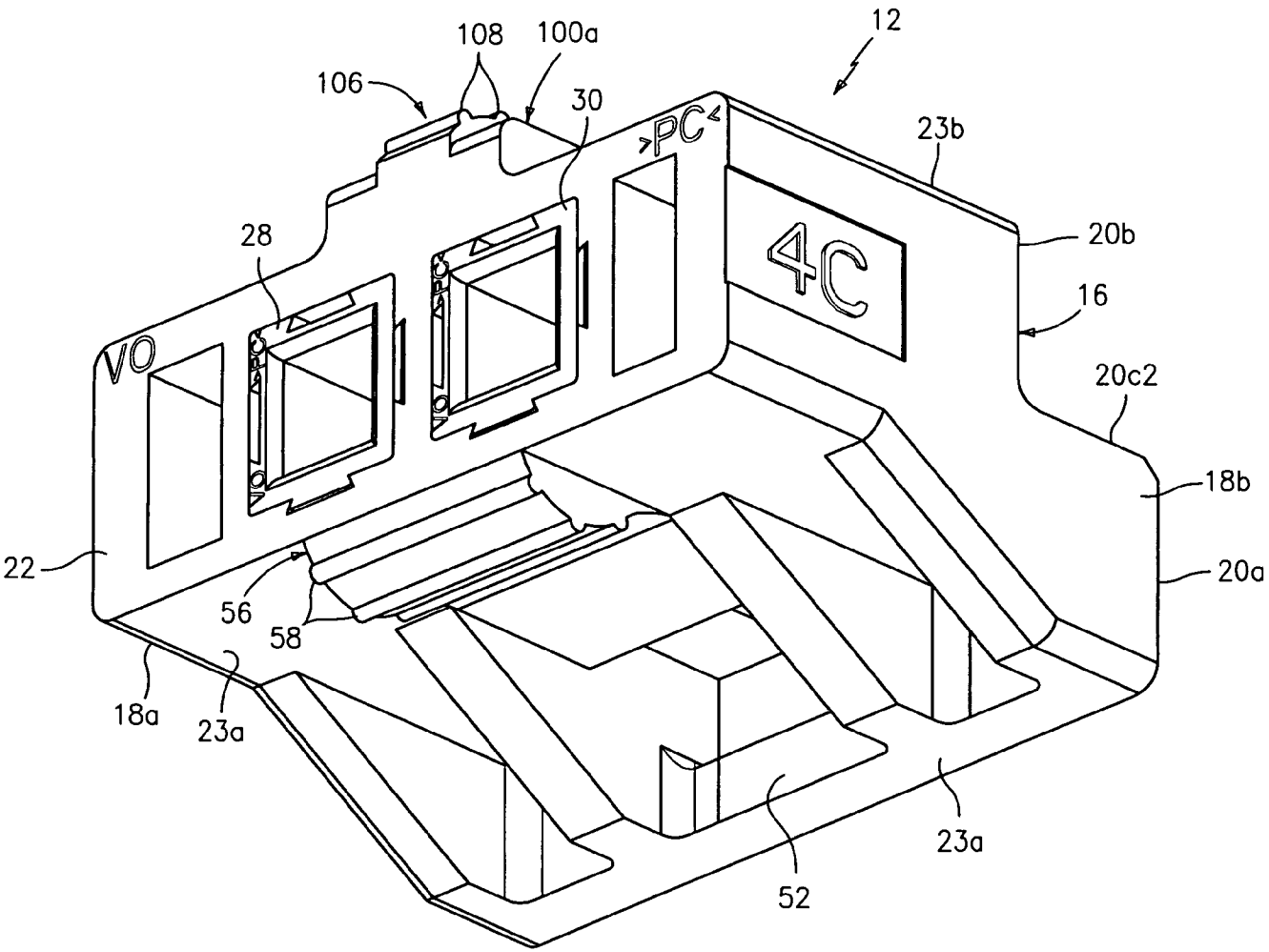
FIG. 6 is an enlarged perspective view of the receptacle shown in FIG. 1, showing the electrical connecting face thereof.

The insulating housing 16 of the receptacle 12, as best seen in FIGS. 5 and 6, has a pair of side walls 18*a*, 18*b*, three end walls 20*a*, 20*b*, 22, a top wall 23*a* and a bottom wall 23*b*. Together all the walls define rectangular interior cavities 24, 26 (FIG. 2) for receiving therein rectangular electrical contact housings 28, 30, respectively. Electrical contact housings 28, 30 are off-the-shelf electrical contact housings known in the art. It is contemplated, however, to custom design electrical contact housings 28, 30 and configure cavities 24, 26 accordingly for fitting custom designed housings 28, 30 therein. Preferably, electrical contact housings 28, 30 are color coded for easily differentiating between the positive and negative terminals.

End wall 20*a* protrudes distally from end wall 20*b* defining lateral wall 20*c* having a first wall 20*c*1 and a second wall 20*c*2 (FIG. 5). Each of the first and second walls 20*c*1, 20*c*2 includes a step 21*a*, 21*b*. A portion of the electrical contact housings 28, 30 rest on the first and second walls 20*c*1, 20*c*2 adjacent the steps 21*a*, 21*b*. Together the three ends walls 20*a*, 20*b*, 20*c* define a keying wall 20 which is part of a second keying arrangement for assuring the intended receptacle 12 is mated with the intended plug 14 and not another receptacle. For example, the second keying arrangement assures a charger receptacle is mated with a battery plug and not another charger receptacle. If an attempt is made to mate a receptacle 12 with another receptacle, keying walls 20 of the two receptacles 12 will not interlock along the mating axis.

A portion of the top wall 23*a* is cut-out to define a rectangular opening 50, a step wall 52 and side walls 54*a*, 54*b* (FIG. 5) substantially perpendicular to end walls 20*a*, 20*b*. A portion 56 of the top wall 23*a* is raised in an arced configuration to facilitate and provide for the gripping of the insulating housing 16 during mating of receptacle 12 with plug 14. To facilitate further gripping of the receptacle 12, a portion of the raised top wall 23*a* is also raised to form gripping members 58 thereon. The portion 56 lies directly behind the rectangular opening 50 and the step wall 52.

Figure 3:
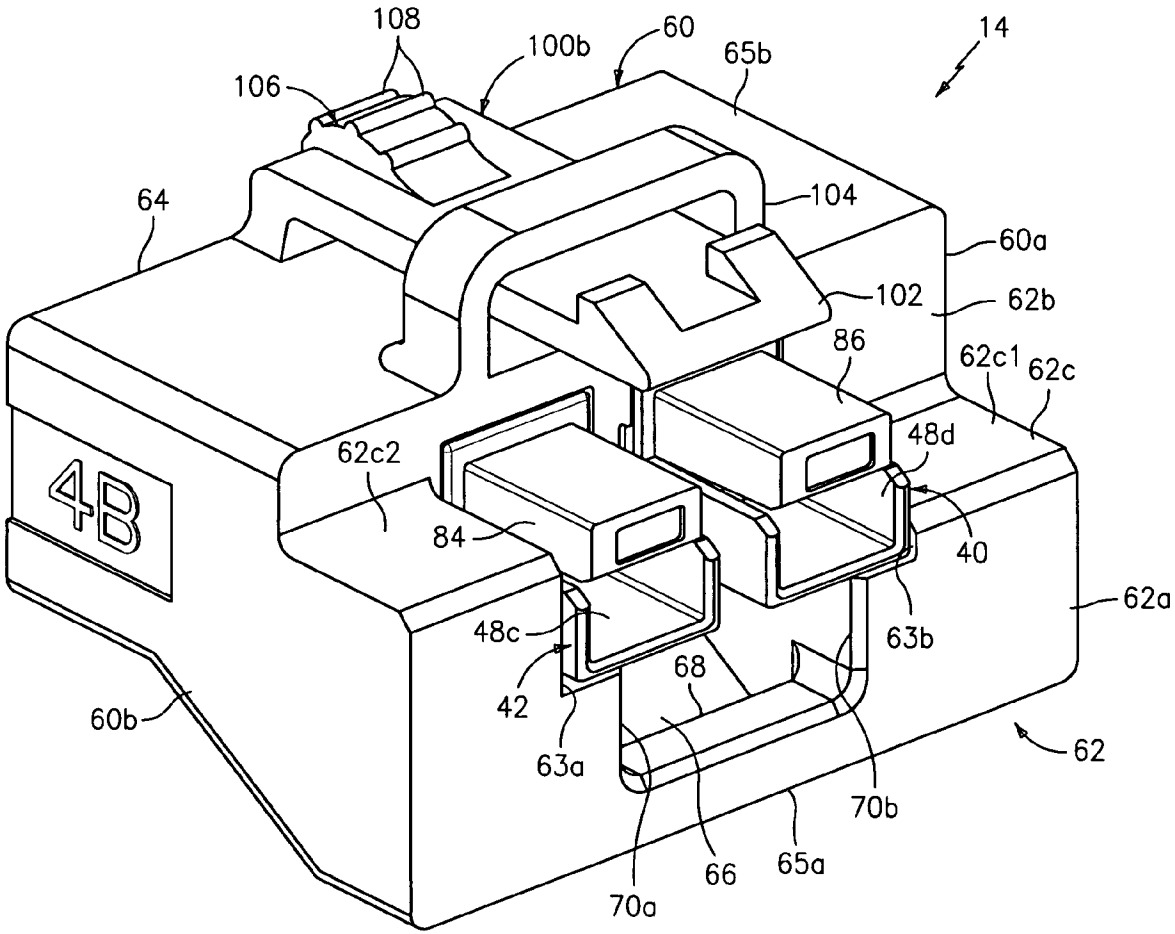
FIG. 3 is an enlarged perspective view of the plug shown in FIG. 1, showing the mating face thereof.
Figure 4:
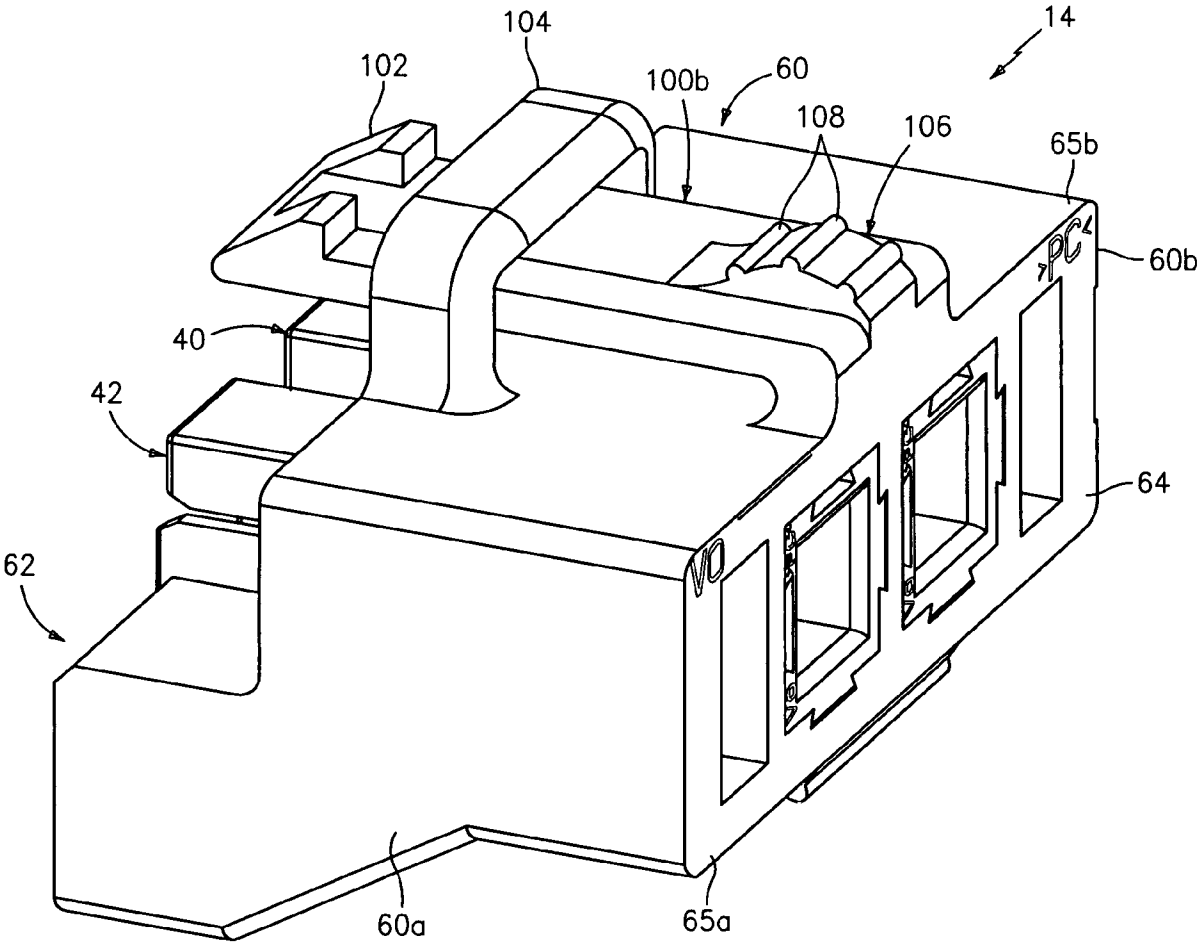
FIG. 4 is an enlarged perspective view of the plug shown in FIG. 1, showing the electrical connecting face thereof.

The plug 14 includes an insulating housing 60, as best seen in FIGS. 3 and 4, and has a structure substantially similar to the structure of receptacle 12. Even though the structure of plug 14 is substantially similar to the structure of receptacle 12, a description of the structure of plug 14 is provided herein for complete description of electrical connector assembly 10.

Insulating housing 60 of plug 14 has a pair of side walls 60*a*, 60*b*, three end walls 62*a*, 62*b*, 64, a top wall 65*a* and a bottom wall 65*b*. Together all the walls define rectangular interior cavities 44, 46 (FIG. 2) for receiving therein rectangular electrical contact housings 40, 42, respectively. Electrical contact housings 40, 42 are similar in structure to the electrical contact housings 28, 30. Electrical contact housings 40, 42 are off-the-shelf electrical contact housings known in the art. It is contemplated, however, to custom design electrical contact housings 40, 42 and configure cavities 44, 46 accordingly for fitting custom designed housings 40, 42 therein. Preferably, electrical contact housings 40, 42 are color coded for easily differentiating between the positive and negative terminals.

End wall 62*a* protrudes distally from end wall 62*b* defining lateral wall 62*c* having a first wall 62*c*1 and a second wall 62*c*2. Each of the first and second walls 62*c*1, 62*c*2 includes a step 63*a*, 63*b*. A portion of the electrical contact housings 40, 42 rest on the first and second walls 62*c*1, 62*c*2 adjacent the steps 63*a*, 63*b*. Together the three ends walls 62*a*, 62*b*, 62*c* form a keying wall 62 which is substantially complementary to keying wall 20 and also forms a part of the second keying arrangement.

A portion of the top wall 65*a* is cut-out to define a rectangular opening 66, a step wall 68 and side walls 70*a*, 70*b* (FIG. 3) substantially perpendicular to end walls 62*a*, 62*b*. A portion 72 (FIG. 8) of the top wall 65*a* is raised in an arced configuration to provide for the gripping of the insulating housing 60 during mating of the receptacle 12 with the plug 14. To provide for further gripping of the plug 14, a portion of the raised top wall 65*a* is also raised to form gripping members 74 thereon. The portion 72 lies directly behind the rectangular opening 66 and the step wall 68.

Figure 2:
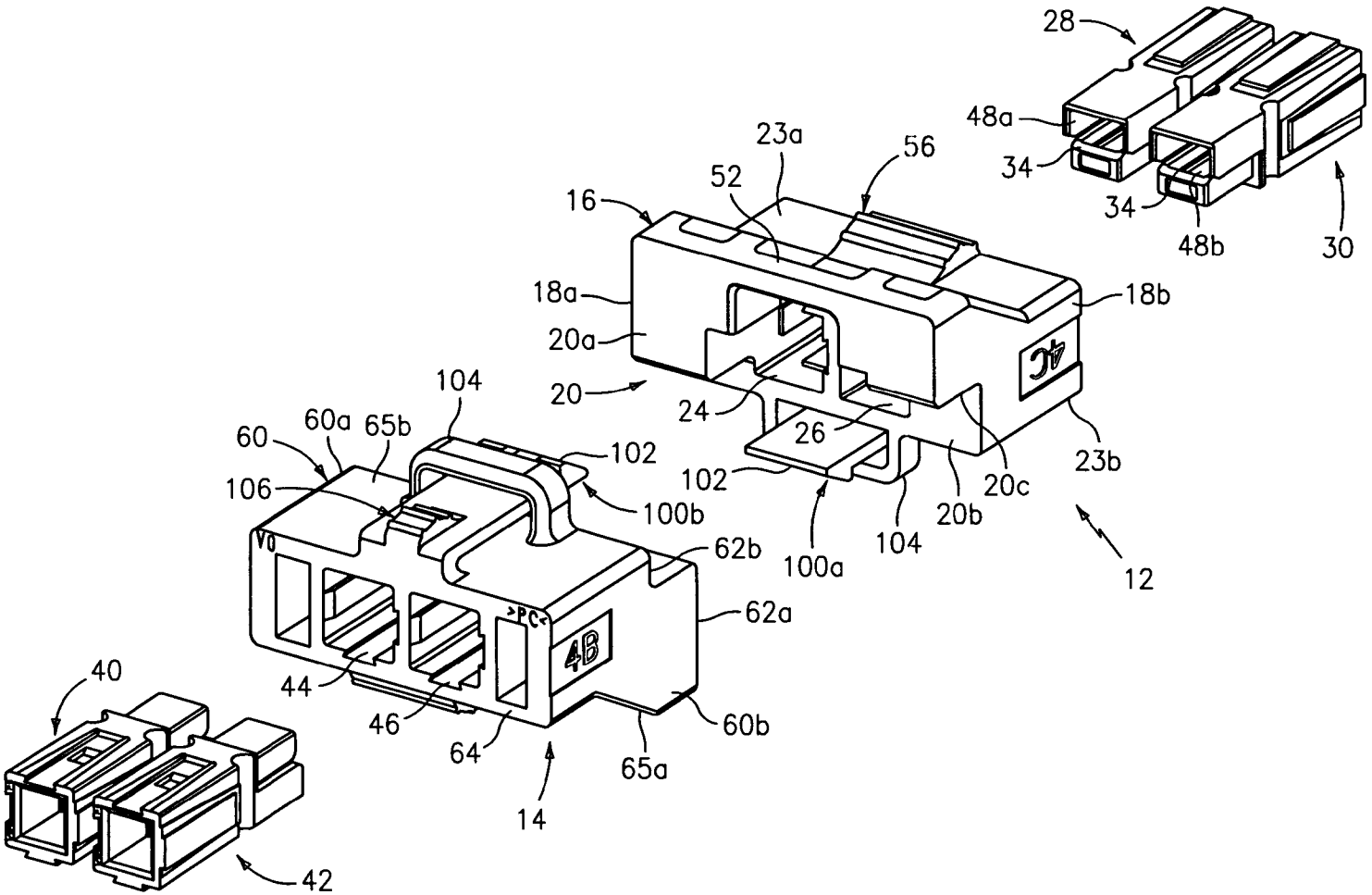
FIG. 2 is an exploded perspective view of the electrical connector assembly showing the electrical contact housings removed from the plug and receptacle.

Interior cavities 24, 26 and electrical contact housings 28, 30, as best seen in FIG. 2, include complementary grooves and projections configured and dimensioned for respectively engaging each other when the electrical contact housings 28, 30 are inserted within interior cavities 24, 26. Electrical contacts 34 are provided within electrical contact housings 28, 30 for engaging electrical contacts 38 within electrical contact housings 40, 42 of the plug 14 when the plug 12 is mated with the plug 14 (FIG. 8). The electrical contacts 34, 38 have wire crimps or other electrical configurations for being connected to electrical wiring. Electrical contact housings 40, 42 are configured and dimensioned for fitting within interior cavities 44, 46 of the plug 14.

A third keying arrangement is provided by electrical connector assembly 10 to prevent inadvertent mating of electrical contacts 34 of a plug 14 having a particular electrical rating with electrical contacts 34 of a receptacle 12 having a different electrical rating as further described below. The third keying arrangement is provided in part by the two pairs of electrical contact housings 28, 30, 40, 42. Each electrical contact housing is configured and dimensioned to fit within one of the interior cavities 24, 26, 44, 46 defined by the walls of electrical connector housings 16, 60. Each electrical contact housing 28, 30 fitted within an interior cavity 24, 26 of receptacle 12 includes a respective key 80, 82 (FIG. 5). Each key 80, 82 has a rectangular shaped outer surface that is sized to slip fit into an opposing rectangular shaped opening 48*c*, 48*d* (FIG. 3) of a respective electrical contact housing 40, 42 fitted within an interior cavity 44, 46 of plug 14 having the same electrical rating as receptacle 12.

Likewise, each electrical contact housing 40, 42 fitted within an interior cavity 44, 46 of plug 14 includes a respective key 84, 86 (FIG. 3) having rectangular shaped outer surface that is sized to slip fit into an opposing rectangular shaped opening 48*a*, 48*b* (FIGS. 2 and 5) of a respective electrical contact housings 28, 30 fitted within an interior cavity 24, 26 of receptacle 12 having the same electrical rating as plug 14. Each key is arranged so that housings 16, 60 will mate only when the four keys are in mating alignment with their respective opening and the two housings 16, 60 are is axial alignment. The retainer means provided by the first keying arrangement holds each key of the two pairs of keys in its respective opening.

To prevent inadvertent mating of electrical contacts 34 of a plug 14 having a particular electrical rating with electrical contacts 34 of a receptacle 12 having a different electrical rating, the third keying arrangement provides for the spacing between cavities 24, 26, 44, 46 of connector housings 16, 60 having different electrical ratings be different as shown by FIGS. 9*a*–9*f*. The different spacing between cavities of first and second electrical connectors, or receptacle 12 and plug 14, having different electrical ratings prevents axial alignment and mating of the keys 80, 82 84, 86 fitted within these electrical connectors with their respective openings 24, 26, 44, 46, and hence mating of the electrical connectors, or receptacle 12 and plug 14.

With reference to FIGS. 9*a*–9*f*, there are shown six different electrically rated electrical connector assemblies 10*a*–10*f*. The electrical rating of receptacle 12*a* and plug 14*a* is 6V, 4 Ah; the electrical rating of receptacle 12*b* and plug 14*b* is 6V, 10 Ah; the electrical rating of receptacle 12*c* and plug 14*c* is 12V, 12 Ah; the electrical rating of receptacle 12*d* and plug 14*d* is 18V; the electrical rating of receptacle 12*e* and plug 14*e* is 24V; and the electrical rating of receptacle 12*f* and plug 14*f* is 32V. Accordingly, for each different electrically rated electrical connector assembly 10*a*–10*f*, the spacing between cavities 44, 46 of plug 14 and cavities 24, 26 of receptacle 12 is different to prevent inadvertent axial alignment and mating of the electrical contact housings 28, 30 fitted within cavities 24, 26 with the electrical contact housings 40, 42 fitted within cavities 44, 46. To retain the same structure and size (each electrical connector has the same length, width and height) for receptacle 12 and plug 14 regardless of their electrical rating, a well 110 is defined between the cavities as shown by FIGS. 9*d*–9*f* for the higher electrically rated assemblies 10*d*–10*f*, and two wells 112 are defined on either side of the cavities as shown by FIGS. 9*a*–9*c* for the lower electrically rated assemblies 10*a*–10*c*.

It is to be understood that the foregoing description is merely a disclosure of particular embodiments and is no way intended to limit the scope of the invention. Other possible modifications will be apparent to those skilled in the art and all modifications will be apparent to those in the art and all modifications are to be defined by the following claims.

What is claimed is:

1. An electrical connector assembly comprising:

a first and a second electrical connector connectable along an axis, each electrical connector including a housing configured and dimensioned for receiving a pair of electrical contact housings, each electrical contact housing having electrical contacts therein, wherein each electrical contact of said first electrical connector contacts a corresponding contact of said second electrical connector during connection thereof;

a first keying arrangement for polarizing to assure proper orientation of said first electrical connector with said second electrical connector during connection thereof; and a second keying arrangement for inhibiting said connection except for connecting a first electrical connector to a designated second electrical connector, comprising:

a first keying wall defined by said first electrical connector housing and a second keying wall defined by said second electrical connector housing, where the first and second keying walls are substantially complementary with respect to each other for enabling connection of said first and second electrical connector housings along said axis when said housings are in axial alignment, a portion of said first keying wall of said first electrical connector housing defining a pair of openings and a portion of said second keying wall of said second electrical connector housing defining a corresponding pair of openings, each opening defining a key-receiving axis therealong parallel to the axis so that when said housings are connected said pair of openings in said first electrical connector housing are in axial alignment with said corresponding pair of openings in said second electrical connector housing.

2. The electrical connector assembly according to claim 1, wherein each keying wall includes a plurality of surfaces, wherein at least two surfaces of said plurality of surfaces are substantially perpendicular and at least two surfaces of said plurality of surfaces are substantially coplanar.

3. The electrical connector assembly according to claim 1, further comprising locking means having a first locking tab configured and dimensioned for being received within an opening formed by said first electrical connector housing and a second locking tab configured and dimensioned for being received within a second opening formed by said second electrical connector housing, wherein said locking means retains said housings in a locked configuration.

4. The electrical connector assembly according to claim 3, wherein each locking tab includes a distal end having a surface for engaging a surface substantially opposite said keying wall of one of said first and second electrical connector housings.

5. The electrical connector assembly according to claim 1, wherein each said opening is rectangular and each said electrical contact housing is of corresponding rectangular shape.

6. The electrical connector assembly according to claim 1, wherein each pair of electrical contact housings have body sections sized to slip fit into a corresponding one of said openings.

7. The electrical connector assembly according to claim 1, wherein each electrical contact housing includes a key comprising an offset portion extending forwardly from a rear portion of said keying wall and being substantially flush with a forward portion of said keying wall when said electrical contact housing is slip fit into said corresponding opening, whereby said electrical contact housings fitted within said first and second electrical connectors are substantially identical and provide a third keying arrangement.

8. The electrical connector assembly according to claim 7, wherein said electrical contacts are provided on at least one surface of each of said keys.

9. The electrical connector assembly according to claim 1, wherein each of said openings extends completely through its respective housing.

10. The electrical connector assembly according to claim 1, wherein each of said housings includes at least one gripping member.

11. The electrical connector assembly according to claim 10, wherein said at least one gripping member is integral with said housing.

12. An electrical connector assembly comprising:

a first and a second electrical connector connectable along an axis, each first and second electrical connector including a housing configured and dimensioned for receiving an electrical contact housing having at least one electrical contact therein, wherein each contact of said first electrical connector contacts a corresponding contact of said second electrical connector during connection thereof;

a first keying arrangement for polarizing to assure proper orientation of said first electrical connector with said second electrical connector during connection thereof; and a second keying arrangement for inhibiting said connection except for connecting a first electrical connector to a designated second electrical connector, comprising:

a first keying wall defined by said first electrical connector housing and a second keying wall defined by said second electrical connector housing, where the first and second keying walls are substantially complementary with respect to each other for enabling connection of said first and second electrical connector housings along said axis when said housings are in axial alignment, a portion of said first keying wall of said first electrical connector housing defining an opening and a portion of said second keying wall of said second electrical connector housing defining a corresponding opening, each opening defining a key-receiving axis therealong parallel to the axis so that when said housings are connected said opening in said first electrical connector housing is in axial alignment with said corresponding opening in said second electrical connector housing.

13. The electrical connector assembly according to claim 12, wherein each keying wall includes a plurality of surfaces, wherein at least two surfaces of said plurality of surfaces are substantially perpendicular and at least two surfaces of said plurality of surfaces are substantially coplanar.

14. The electrical connector assembly according to claim 12, further comprising locking means having a first locking tab configured and dimensioned for being received within an opening formed by said first electrical connector housing and a second locking tab configured and dimensioned for being received within a second opening formed by said second electrical connector housing, wherein said locking means retains said housings in a locked configuration.

15. The electrical connector assembly according to claim 14, wherein each locking tab includes a distal end having a surface for engaging a surface substantially opposite said keying wall of one of said first and second electrical connector housings.

16. The electrical connector assembly according to claim 12, wherein each said opening is rectangular and each said electrical contact housing is of corresponding rectangular shape.

17. The electrical connector assembly according to claim 12, wherein each electrical contact housing has a body section sized to slip fit into a corresponding one of said openings.

18. The electrical connector assembly according to claim 12, wherein each electrical contact housing includes a key comprising an offset portion extending forwardly from a rear portion of said keying wall and being substantially flush with a forward portion of said keying wall when said electrical contact housing is slip fit into said corresponding opening, whereby said electrical contact housings fitted within said first and second electrical connectors are substantially identical and provide a third keying arrangement.

19. The electrical connector assembly according to claim 18, wherein said at least one electrical contact is provided on at least one surface of each of said keys.

20. The electrical connector assembly according to claim 12, wherein each of said openings extends completely through its respective housing.

21. An electrical connector system comprising:

a plurality of electrical connectors each having at least two identical dimensions and a particular electrical rating selected from a plurality of electrical ratings, each of said plurality of electrical connectors including a housing configured and dimensioned for only connecting to a housing of at least one electrical connector of said plurality of electrical connectors having the same electrical rating such that each of the plurality of electrical connectors includes a specific housing from a plurality of different housings, each housing further defining at least one cavity for axially aligning with at least one cavity defined by another housing during connection of said housings;

wherein the plurality of electrical connectors provide a plurality of electrical connector assemblies, each electrical connector assembly comprising:

a first and a second electrical connector connectable along an axis, each first and second electrical connector including said housing configured and dimensioned for receiving an electrical contact housing having at least one electrical contact therein, wherein each contact of said first electrical connector contacts a corresponding contact of said second electrical connector during connection thereof;

a first keying arrangement for polarizing to assure proper orientation of said first electrical connector with said second electrical connector during connection thereof; and a second keying arrangement for inhibiting said connection except for connecting a first electrical connector to a designated second electrical connector, comprising:

a first keying wall defined by said first electrical connector housing and a second keying wall defined by said second electrical connector housing, where the first and second keying walls are substantially complementary with respect to each other for enabling connection of said first and second electrical connector housings along said axis when said housings are in axial alignment, a portion of said first keying wall of said first electrical connector housing defining an opening and a portion of said second keying wall of said second electrical connector housing defining a corresponding opening, each opening defining a key-receiving axis therealong parallel to the axis so that when said housings are connected said opening in said first electrical connector housing is in axial alignment with said corresponding opening in said second electrical connector housing.

22. The electrical connector system according to claim 21, wherein each keying wall includes a plurality of surfaces, wherein at least two surfaces of said plurality of surfaces are substantially perpendicular and at least two surfaces of said plurality of surfaces are substantially coplanar.

23. The electrical connector system according to claim 21, wherein each electrical connector assembly further comprises locking means having a first locking tab configured and dimensioned for being received within an opening formed by said first electrical connector housing and a second locking tab configured and dimensioned for being received within a second opening formed by said second electrical connector housing, wherein said locking means retains said housings in a locked configuration.

24. The electrical connector system according to claim 23, wherein each locking tab includes a distal end having a surface for engaging a surface substantially opposite said keying wall of one of said first and second electrical connector housings.

25. An electrical connector assembly comprising:

a first and a second electrical connector connectable along an axis, each first and second electrical connector including a housing configured and dimensioned for receiving a pair of electrical contact housings, each electrical contact housing having electrical contacts therein, wherein each electrical contact of said first electrical connector contacts a corresponding contact of said second electrical connector during connection thereof;

a first keying arrangement for polarizing to assure proper orientation of said first electrical connector with said second electrical connector during connection thereof, the first keying arrangement including a cantilever beam for locking the first and second electrical connectors with respect to each other during connection thereof; and a second keying arrangement for inhibiting said connection except for connecting a first electrical connector to a designated second electrical connector, comprising:

a first keying wall defined by said first electrical connector housing and a second keying wall defined by said second electrical connector housing, where the first and second keying walls are substantially complementary with respect to each other for enabling connection of said first and second electrical connector housings along said axis when said housings are in axial alignment, a portion of said first keying wall of said first electrical connector housing defining an opening and a portion of said second keying wall of said second electrical connector housing defining a corresponding opening, each opening defining an axis therealong parallel to the axis so that when said housings are connected said opening in said first electrical connector housing is in axial alignment with said corresponding opening in said second electrical connector housing.

* * * * *